US008875332B2

(12) United States Patent
Janke et al.

(10) Patent No.: US 8,875,332 B2
(45) Date of Patent: Nov. 4, 2014

(54) LAUNDRY TREATING APPLIANCE AND METHOD OF OPERATION

(75) Inventors: Brian P. Janke, Saint Joseph, MI (US); Horacio B. Polli, Joinville (BR); Peter J. Richmond, Berrien Springs, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 34 days.

(21) Appl. No.: 13/545,459

(22) Filed: Jul. 10, 2012

(65) Prior Publication Data

US 2014/0013518 A1 Jan. 16, 2014

(51) Int. Cl.
*D06F 33/02* (2006.01)
*D06F 37/22* (2006.01)

(52) U.S. Cl.
USPC ..... 8/158

(58) Field of Classification Search
USPC ..... 8/158, 159
See application file for complete search history.

(56) References Cited

U.S. PATENT DOCUMENTS

| | | | | |
|---|---|---|---|---|
| 5,692,313 | A * | 12/1997 | Ikeda et al. | 34/58 |
| 5,765,402 | A | 6/1998 | Ikeda et al. | |
| 5,893,280 | A * | 4/1999 | Honda et al. | 68/12.06 |
| 6,029,300 | A * | 2/2000 | Kawaguchi et al. | 8/159 |
| 6,418,758 | B1 | 7/2002 | Ikeda et al. | |
| 6,564,592 | B2 | 5/2003 | Bruce et al. | |
| 7,506,392 | B2 | 3/2009 | Croxton | |
| 7,905,122 | B2 | 3/2011 | Murray et al. | |
| 8,627,525 | B2 * | 1/2014 | Jurmann | 8/158 |
| 8,627,688 | B2 * | 1/2014 | Volpato et al. | 68/12.06 |
| 2002/0020196 | A1 * | 2/2002 | Kakuda et al. | 68/12.06 |
| 2003/0046962 | A1 * | 3/2003 | Sonoda et al. | 68/12.06 |
| 2004/0211009 | A1 * | 10/2004 | Murray et al. | 8/159 |
| 2005/0204482 | A1 * | 9/2005 | Murray et al. | 8/158 |
| 2006/0207299 | A1 * | 9/2006 | Okazaki et al. | 68/12.02 |
| 2008/0141731 | A1 | 6/2008 | Seiichiro et al. | |
| 2009/0107185 | A1 | 4/2009 | Filippa et al. | |
| 2009/0151085 | A1 * | 6/2009 | Altinier et al. | 8/159 |
| 2009/0288260 | A1 * | 11/2009 | Jurmann | 8/159 |
| 2010/0000022 | A1 | 1/2010 | Hendrickson et al. | |
| 2010/0000024 | A1 | 1/2010 | Hendrickson et al. | |
| 2010/0000264 | A1 | 1/2010 | Luckman et al. | |
| 2010/0000573 | A1 | 1/2010 | Hendrickson et al. | |
| 2010/0000581 | A1 | 1/2010 | Doyle et al. | |
| 2010/0000586 | A1 | 1/2010 | Hendrickson | |
| 2010/0263136 | A1 * | 10/2010 | Ashrafzadeh et al. | 8/159 |
| 2011/0314875 | A1 | 12/2011 | Albayrak et al. | |

FOREIGN PATENT DOCUMENTS

| | | | | |
|---|---|---|---|---|
| EP | 1113102 | B1 | 7/2003 | |
| WO | 2006040412 | A1 | 4/2006 | |
| WO | WO 2007118512 | A1 * | 10/2007 | D06F 37/20 |

* cited by examiner

*Primary Examiner* — Joseph L Perrin

(57) ABSTRACT

A laundry treating appliance for treating a laundry load according to at least one cycle of operation and a method of operating a laundry treating appliance to determine an amount of imbalance of the laundry load in the drum based on a determined average peak-to-peak value and taking corrective action when the determined amount of imbalance does not satisfy a threshold.

17 Claims, 7 Drawing Sheets

LAUNDRY TREATING APPLIANCE AND METHOD OF OPERATION

BACKGROUND

Laundry treating appliances, such as clothes washers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The controller may control a motor to rotate the drum according to one of the cycles of operation, during such rotation the laundry may not distribute equally about the inner surface of the drum leading to an imbalance. If a sufficiently large enough load imbalance is present, the laundry treating appliance may experience undesirable vibrations and movements when the drum is rotated at spin speeds.

BRIEF SUMMARY

According to an embodiment of the invention, a method of operating a laundry treating appliance having a drum at least partially defining a treating chamber for receiving a laundry load, and a motor for rotating the drum, the method includes rotating the drum by operating the motor, repeatedly determining an amplitude of a peak-to-peak value of the motor torque during the rotating of the drum to provide multiple peak-to-peak values, determining an average peak-to-peak value from the multiple peak-to-peak values, determining an amount of imbalance of the laundry load in the drum based on the determined average peak-to-peak value, comparing the amount of imbalance to a threshold imbalance value, and taking corrective action when the comparison indicates the determined amount of imbalance does not satisfy the threshold imbalance.

According to another embodiment of the invention, a laundry treating appliance for treating a laundry load according to at least one cycle of operation includes a rotatable drum at least partially defining a treating chamber for receiving the laundry load for treatment, a motor rotationally driving the drum, a speed sensor providing a speed output indicative of a rotational speed of the drum, a motor torque sensor providing a torque output indicative of the torque applied by the motor, and a controller receiving as inputs the speed output and the torque output, and determining an amount of imbalance of the laundry load in the drum based on a determined average peak-to-peak value, comparing the amount of imbalance to a threshold value, and taking corrective action when the comparison indicates the determined amount of imbalance does not satisfy the threshold.

DESCRIPTION OF EMBODIMENTS OF THE INVENTION

Figure 1:
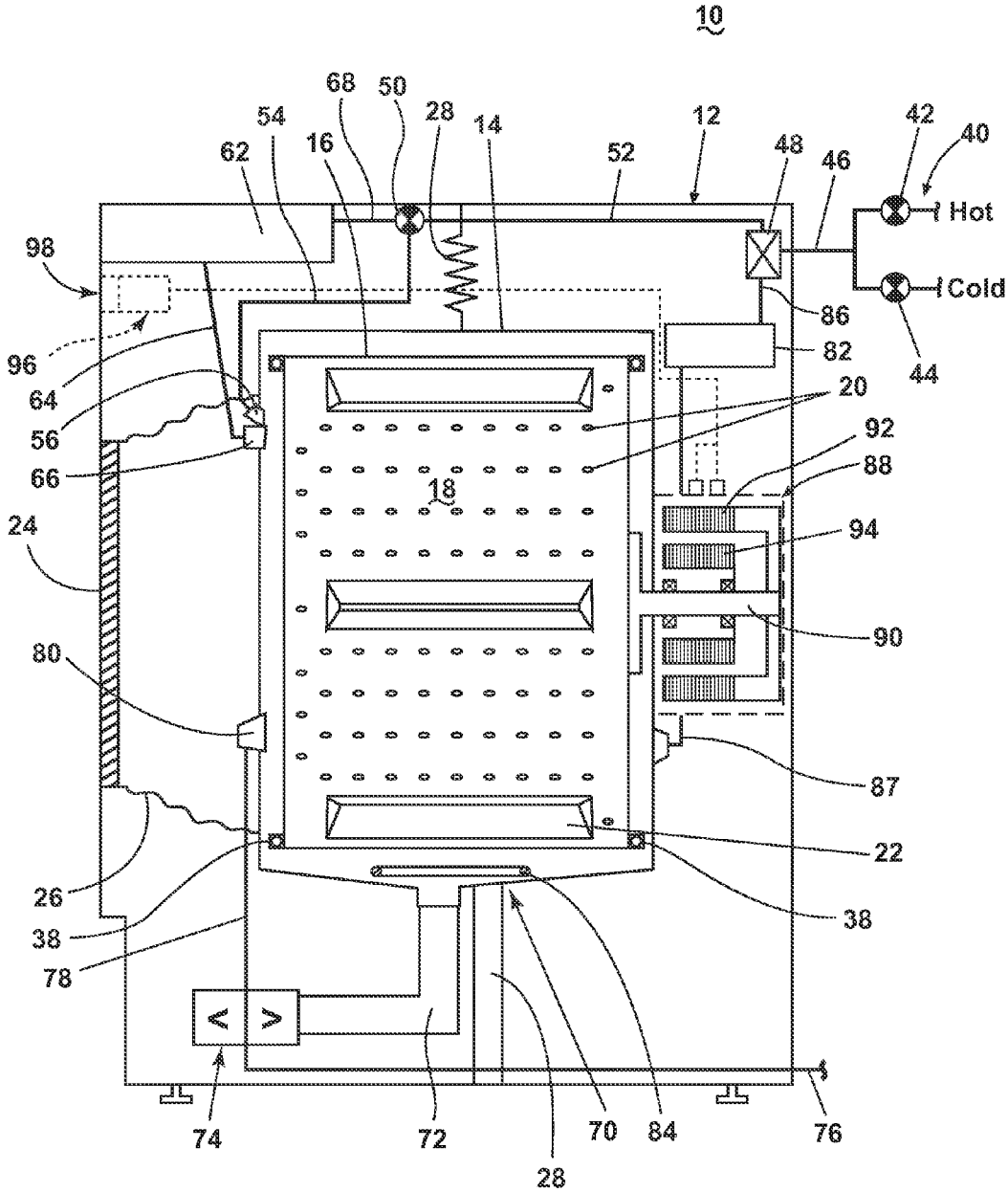
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18 for receiving a laundry load for treatment. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled to the rotating drum 16 and configured to compensate for a dynamic imbalance during rotation of the rotatable drum 16. The balancing material may be in the form of balls, fluid or a combination thereof. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled to opposite ends of the rotatable drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, entitled "Apparatus and Method for Controlling Laundering Cycle by Sensing Wash Aid Concentration," U.S. Pub. No. 2010/0000573 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, entitled "Household Cleaning Appliance with a Single Water Flow Path for Both Non-Bulk and Bulk Dispensing," and application Ser. No. 13/093,132, filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
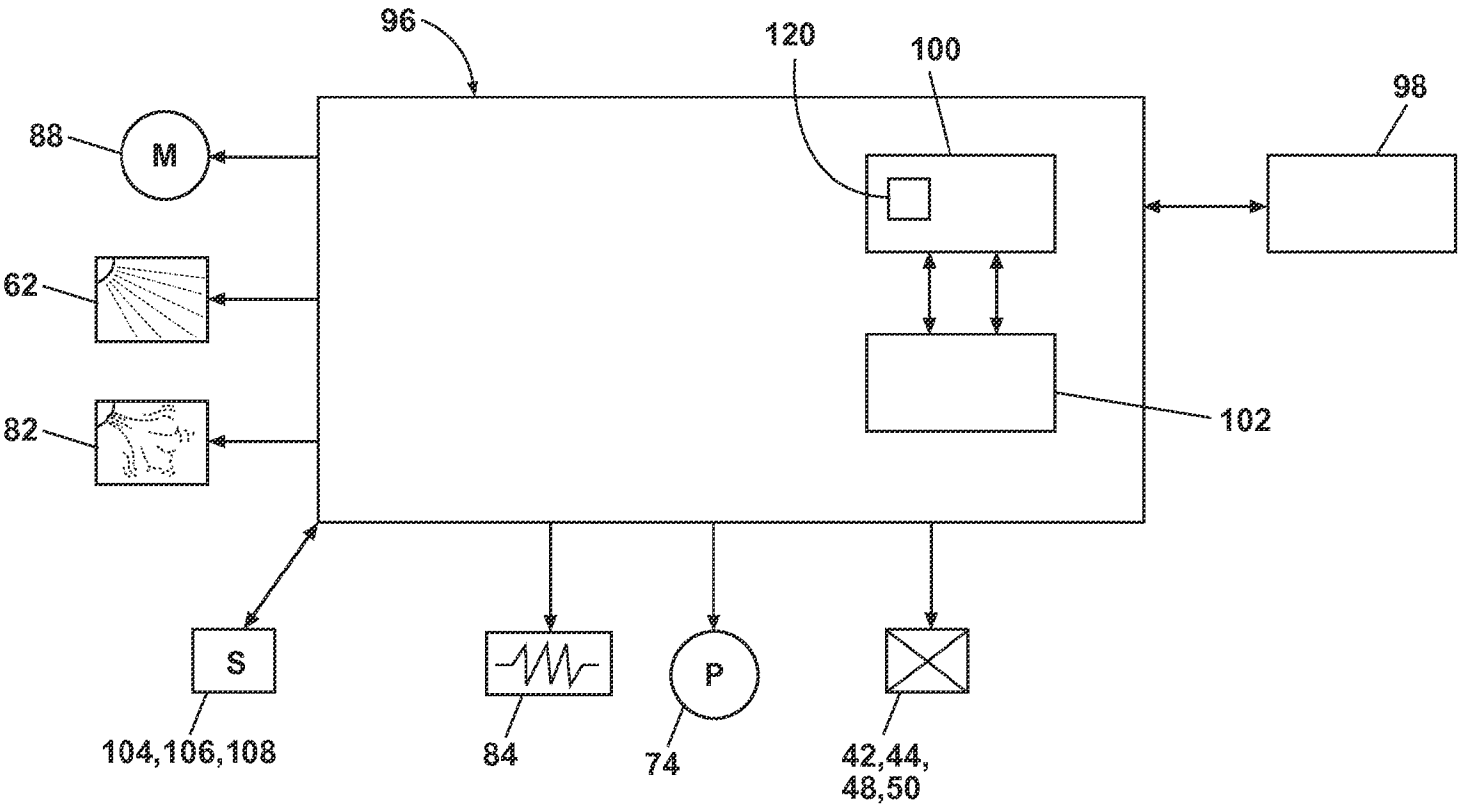
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input. For example, a table of a plurality of threshold values 120 may be included.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, a load size sensor, and a motor torque sensor, which may be used to determine a variety of system and laundry characteristics, such as laundry load inertia or mass.

In one example, a motor sensor such as a motor torque sensor 106 may also be included in the washing machine 10 and may provide a torque output indicative of the torque applied by the motor 88. The motor torque is a function of the inertia of the rotating drum 16 and the laundry load. The motor torque sensor 106 may also include a motor controller or similar data output on the motor 88 that provides data communication with the motor 88 and outputs motor characteristic information, generally in the form of an analog or digital signal, to the controller 96 that is indicative of the applied torque. The controller 96 may use the motor characteristic information to determine the torque applied by the motor 88 using software that may be stored in the controller memory 100. Specifically, the motor torque sensor 106 may be any suitable sensor, such as a voltage or current sensor, for outputting a current or voltage signal indicative of the current or voltage supplied to the motor 88 to determine the torque applied by the motor 88. Additionally, the motor torque sensor 106 may be a physical sensor or may be integrated with the motor and combined with the capability of the controller 96, may function as a sensor. For example, motor characteristics, such as speed, current, voltage, torque etc., may be processed such that the data provides information in the same manner as a separate physical sensor. In contemporary motors, the motors often have their own controller that outputs data for such information.

As another example, a speed sensor 108 may also be included in the washing machine 10 and may be positioned in any suitable location for detecting and providing a speed output indicative of a rotational speed of the drum 16. Such a speed sensor 108 may be any suitable speed sensor capable of providing an output indicative of the speed of the drum 16. It is also contemplated that the rotational speed of the drum 16 may also be determined based on a motor speed; thus, the speed sensor 108 may include a motor speed sensor for determining a speed output indicative of the rotational speed of the motor 88. The motor speed sensor may be a separate component, or may be integrated directly into the motor 88. Regardless of the type of speed sensor employed, or the coupling of the drum 16 with the motor 88, the speed sensor 108 may be adapted to enable the controller 96 to determine the rotational speed of the drum 16 from the rotational speed of the motor 88.

The previously described washing machine 10 may be used to implement one or more embodiments of the invention. The embodiments of the method of the invention may be used to control the operation of the washing machine 10 to alter execution of the at least one cycle of operation when a determined satellizing speed is not within the satellizing speed range. Such alteration may prove beneficial as the determined satellizing speed may be used in other aspects of the cycle of operation such as when laundry is being distributed within the treating chamber 18 to provide for an acceptable amount of imbalance.

Prior to describing a method of operation of the washing machine 10, a brief summary of the underlying physical phenomena may be useful to aid in the overall understanding. The motor 88 may rotate the drum 16 at various speeds in either rotational direction. In particular, the motor 88 can rotate the drum 16 at speeds to effect various types of laundry load 112 movement inside the drum 16. For example, the laundry load may undergo at least one of tumbling, rolling (also called balling), sliding, satellizing (also called plastering), and combinations thereof. During tumbling, the drum 16 is rotated at a tumbling speed such that the fabric items in the drum 16 rotate with the drum 16 from a lowest location of the drum 16 towards a highest location of the drum 16, but fall back to the lowest location before reaching the highest location. Typically, the centrifugal force applied by the drum to the fabric items at the tumbling speeds is less than about 1 G. During satellizing, the motor 88 may rotate the drum 16 at rotational speeds, i.e. a spin speed, wherein the fabric items are held against the inner surface of the drum and rotate with the drum 16 without falling. This is known as the laundry being satellized or plastered against the drum. Typically, the force applied to the fabric items at the satellizing speeds is greater than or about equal to 1 G. For a horizontal axis washing machine 10, the drum 16 may rotate about an axis that is inclined relative to the horizontal, in which case the term "1 G" refers to the vertical component of the centrifugal force vector, and the total magnitude along the centrifugal force vector would therefore be greater than 1 G. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 16 may be facilitated by the baffles 22.

Centrifugal force (CF) is a function of a mass (m) of an object (laundry item 116), an angular velocity (w) of the object, and a distance, or radius (r) at which the object is located with respect to an axis of rotation, or a drum axis. Specifically, the equation for the centrifugal force (CF) acting on a laundry item 116 within the drum 16 is:

$$CF=m*\omega^2*r \quad (1)$$

The centrifugal force (CF) acting on any single item 116 in the laundry load 112 can be modeled by the distance the center of gravity of that item 116 is from the axis of rotation of the drum 16. Thus, when the laundry items 116 are stacked upon each other, which is often the case, those items having a center of gravity closer to the axis of rotation experience a smaller magnitude centrifugal force (CF) than those items having a center of gravity farther away. It is possible to slow the speed of rotation of the drum 16 such that the closer items 116 will experience a centrifugal force (CF) less than the force required to satellize them, permitting them to tumble, while the farther away items 116 still experience a centrifugal force (CF) equal to or greater than the force required to satellize them, retaining them in a fixed position relative to the drum 16. Using such a control of the speed of the drum 16, it is possible to control the speed of the drum 16 such that the closer items 116 may tumble within the drum 16 while the farther items 116 remain fixed. This method may be used to eliminate an imbalance 114 caused by a mass of stacked laundry items 116 because an imbalance is often caused by a localized "piling" of items 116.

As used in this description, the elimination of the imbalance 114 means that the imbalance 114 is reduced below a maximum magnitude suitable for the operating conditions. It does not require a complete removal of the imbalance 114. In many cases, the suspension system 28 in the washing machine 10 may accommodate a certain amount of imbalance 114. Thus, it is not necessary to completely remove the entire imbalance 114.

Figure 3:
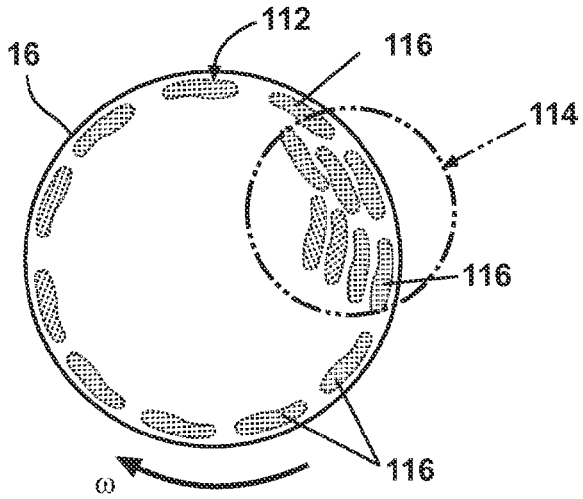
FIG. 3 illustrates a laundry load, including an imbalance, in a drum of the laundry treating appliance of FIG. 1, during a spin phase of a cycle of operation.
Figure 4:
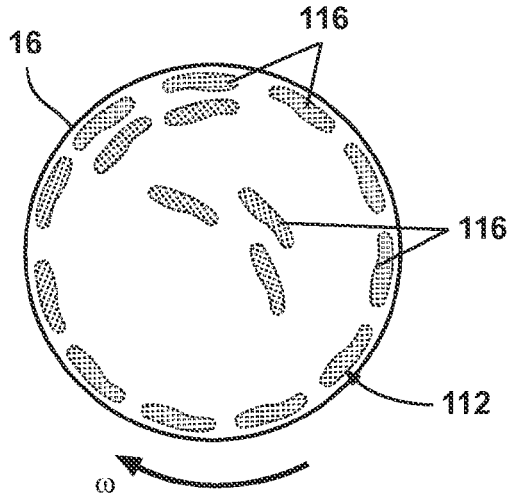
FIG. 4 illustrates the position of the laundry load in the drum as it is redistributed during the cycle of operation.
Figure 5:
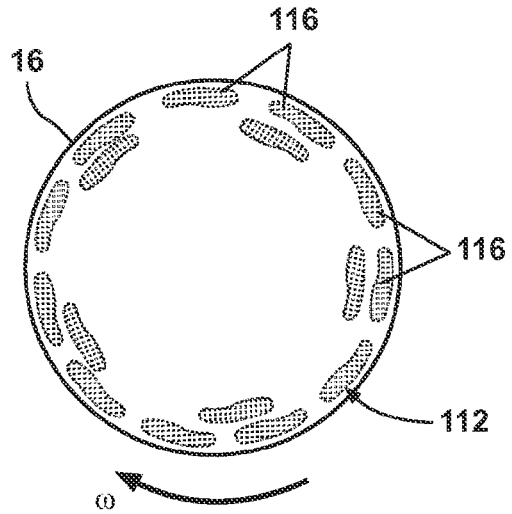
FIG. 5 illustrates the position of the laundry load in the drum after the imbalance has been sufficiently eliminated.

FIGS. 3-5 graphically illustrate such a method. Beginning with FIG. 3, an unequally distributed laundry load 112 is shown in the treating chamber 18 defined by the drum 16 during a spin phase wherein the treating chamber 18 is rotated at a spin speed sufficient to apply a centrifugal force greater than that required to satellize the entire laundry load 112, thereby, satellizing the laundry load 112. However, it can also be seen that not all the laundry items 116 that make up the laundry load 112 are located an equal distance from the axis of rotation. Following the above equation, the centrifugal force (CF) acting on each laundry item 116 in the treating chamber 18 is proportional to the distance from the axis of rotation. Thus, along the radius of the treating chamber 18, the centrifugal force (CF) exhibited on the individual laundry items 116 will vary. Accordingly, the closer the laundry item 116 lies to the axis of rotation, the smaller the centrifugal force (CF) acting thereon. Therefore, to satellize all of the laundry items 116, the treating chamber 18 must be rotated at a spin speed sufficient that the centrifugal force (CF) acting on all of the laundry items 116 is greater than the gravity force acting thereon. It can be correlated that the laundry items 116 pressed against the inner peripheral wall of the treating chamber 18 experience greater centrifugal force (CF) than the laundry items 116 lying closer to the axis of rotation. In other words, during the spin phase and satellization of the laundry load 112, all of the laundry items 116 are experiencing centrifugal force greater than the force required to satellize them, yet not all of the laundry items 116 are experiencing the same centrifugal force (CF).

The imbalance 114 can be seen in the treating chamber 18, as circled in FIG. 3. The imbalance 114 is due to the uneven distribution of the laundry items 116 within the treating chamber 18. Further, the laundry items 116 that create the imbalance 114 will necessarily be those laundry items 116 that are closest to the axis of rotation. FIG. 4 illustrates the position of the laundry load 112 in the treating chamber 18 during a redistribution phase wherein the treating chamber 18 is slowed from the speed of FIG. 3 and rotated at a speed such that some of the laundry items 116 experience less than a centrifugal force required to satellize them, while the remaining laundry items 116 experience a centrifugal force required to satellize them or greater than a centrifugal force required to satellize them. According to the principals described above, as the rotational speed of the treating chamber 18 is reduced, the laundry item 116 or items that contributed to the imbalance 114 will begin to tumble and will be redistributed. Upon redistribution, the treating chamber 18 may be accelerated once again to a speed sufficient to satellize all of the laundry items 116. FIG. 5 illustrates the position where the imbalance 114 is eliminated by a sufficient redistribution and the rotational speed of the treating chamber 18 has been increased again to the spin speed sufficient to satellize the entire laundry load 112.

The deceleration of the drum 16 and acceleration of the drum 16 may include the controller 96 operating the motor 88 such that the speed of the drum 16 is dropped just below the satellizing speed and then brought back up to the satellizing speed such that the speed of the drum 16 oscillates around the satellizing speed, this is sometimes referred to as a short distribution. Alternatively, the deceleration of the drum 16 and acceleration of the drum 16 may include the controller 96 stopping the rotation of the drum 16 altogether and then bringing the drum 16 back up to the satellizing speed, this is sometimes referred to as a long distribution. Regardless of the type of distribution, an accurate satellizing speed is beneficial for the controller 96 to have and use. If the determined satellizing speed is lower than the actual satellizing speed, the controller 96 may attempt to satellize the laundry items and the laundry items may instead tumble. If the determined satellizing speed is higher than the actual satellizing speed, the controller 96 may attempt to redistribute the laundry by tumbling some of the laundry items and the laundry items may instead remain plastered to the drum 16.

Figure 6:
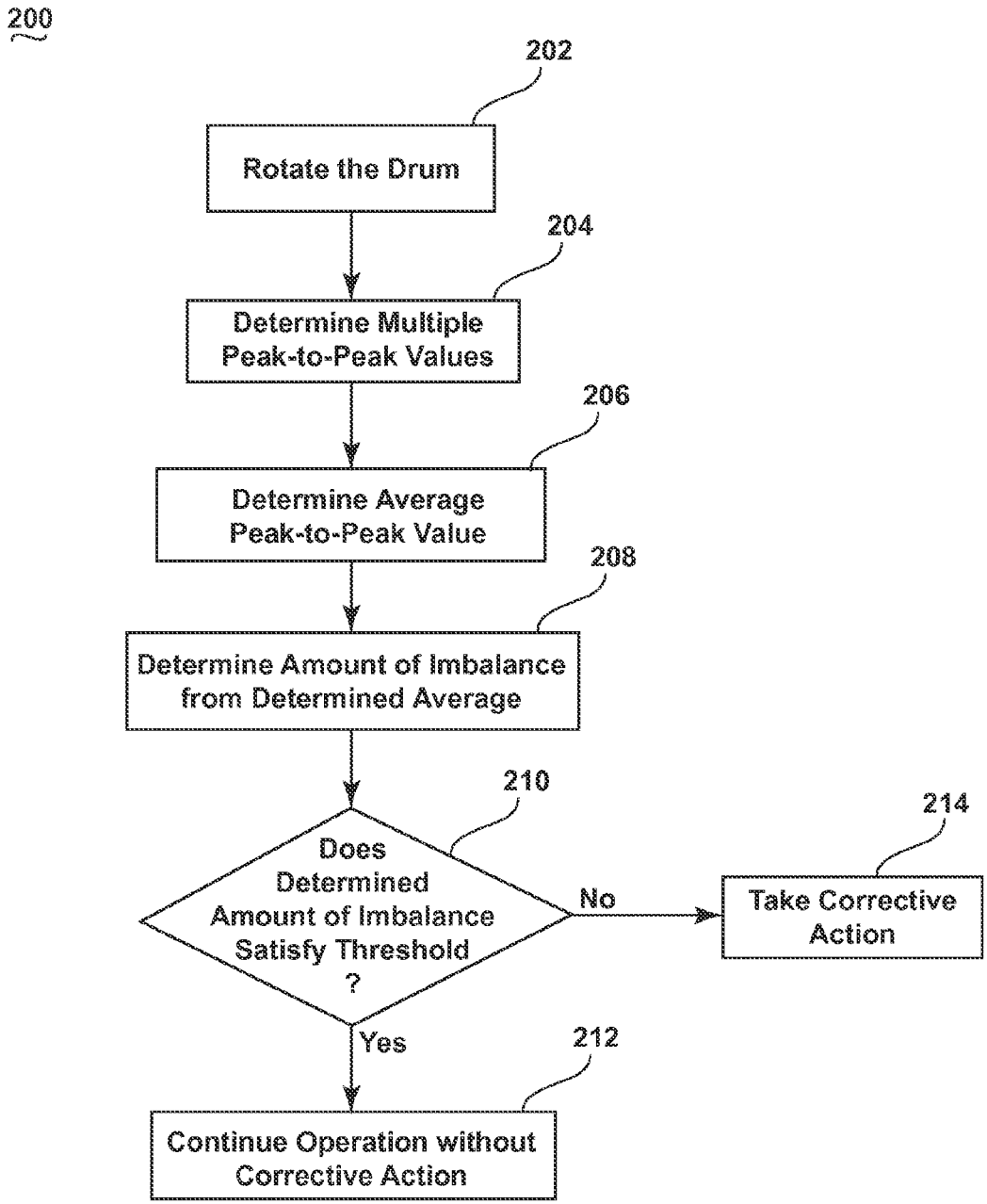
FIG. 6 is a flow chart illustrating a method of operating the washing machine according to a second embodiment of the invention.

Referring now to FIG. 6, a flow chart of a method 200 for altering execution of the at least one cycle of operation of the washing machine 10 when the determined satellizing speed is not within a set satellizing speed range is illustrated. The sequence of steps depicted for this method is for illustrative purposes only, and is not meant to limit the method in any way as it is understood that the steps may proceed in a different logical order or additional or intervening steps may be included without detracting from the invention. The method 200 may be implemented in any suitable manner, such as automatically or manually, as a stand-alone phase or cycle of operation or as a phase of an operation cycle of the washing machine 10. The method 200 starts with assuming that the user has placed one or more laundry items 116 for treatment within the treating chamber 18 and selected a cycle of operation through the user interface 98.

At 202, the controller 96 may accelerate the drum 16 through operation of the motor 88. This may include the drum 16 being rotated by the motor 88 from a non-satellizing speed to a satellizing speed. This may also include rotating the drum 16 through a satellizing speed for the laundry load.

Figure 7:
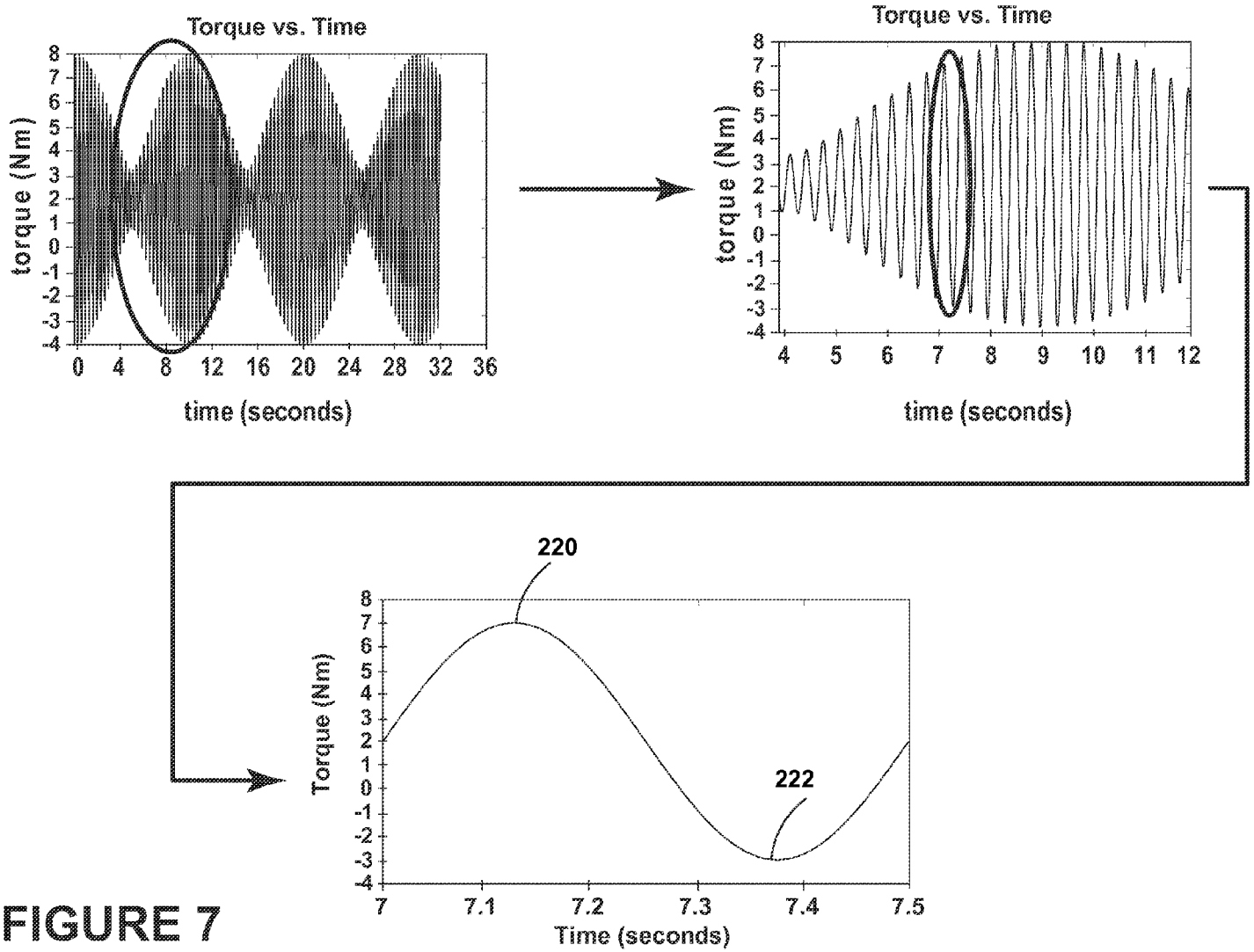
FIG. 7 illustrates a graph of motor torque of a motor that drives the drum from the laundry treating appliance of FIG. 1, with portions of the graph enlarged for clarity.

While the drum 16 is being accelerated, the controller 96 may repeatedly determine an amplitude of a peak-to-peak value of the motor torque to provide multiple peak-to-peak values, as indicated at 204. More specially, the controller 96 may receive one or more signals from the motor 88. From such motor signals, the controller 96 may determine an amplitude of a peak-to-peak value of the motor torque. It will be understood that suck a peak-to-peak value is a high-peak 220 to low-peak 222 value (FIG. 7). This may also be considered a peak to trough value. The controller 96 may repeatedly determine such a peak-to-peak value to provide multiple peak-to-peak values. The peak-to-peak values may be stored by the memory 100 of the controller 96 as individual data values as well as a cumulative value. It is also contemplated that the controller 96 may receive a signal indicative of mechanical power and that a peak-to-peak value of the motor torque may be determined from the mechanical power signal.

At 206, the controller 96 may determine an average peak-to-peak value from the multiple peak-to-peak values. By way of non-limiting examples, a running average and/or a sliding average of the peak-to-peak values can be determined and stored by the controller 96. Regardless of the type of average, the controller 96 at 208 may determine an amount of imbalance of the laundry load in the drum 16 based on the average peak-to-peak value determined at 206. It has been determined that a magnitude of the average peak-to-peak value is proportional to the amount of imbalance.

Figure 8:
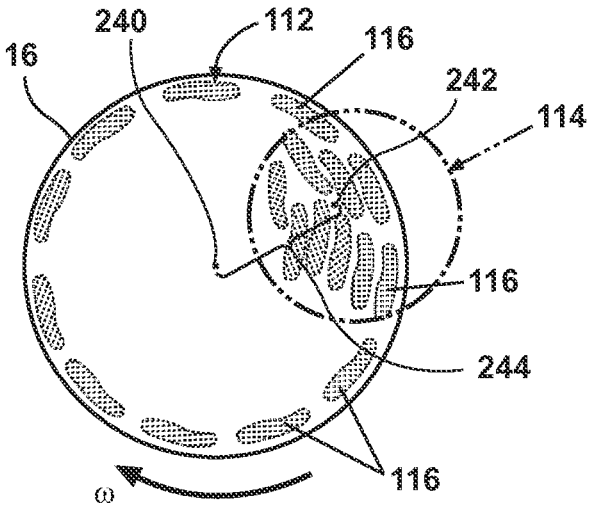
FIG. 8 illustrates a laundry load, including an imbalance, in the drum of the laundry treating appliance of FIG. 1, during a spin phase of a cycle of operation.

Determining an amount of imbalance may include determining a radius 244 (FIG. 8) from a center of rotation of the drum 16 indicated as 240 (FIG. 8) to a center of mass of the imbalance 242 (FIG. 8). It has been determined that the length of the radius 244 is inversely proportional to the amount of imbalance. Determining the radius 244 of the imbalance may include determining a speed at which the laundry load satellizes to define a determined satellizing speed.

As explained above with respect to equation (1) centrifugal force (CF) is a function of a mass (m) of an object (the imbalance 114), an angular velocity (w) of the imbalance, and a radius (r) at which the imbalance is located with respect to an axis of rotation 240. It has been determined that the radius (r) may be determined because at the moment that satellization occurs the centrifugal force (CF) acting on a laundry item 116 within the drum 16 is equal to the gravitational force, which is a function of the mass of the imbalance 114 and gravity, which is shown in the equation:

$$F_c=F_{gravity}=m*g \tag{2}$$

When the equation for centrifugal force is set equal to the equation for gravitational force the equation becomes:

$$m*g=m*R*\omega^2 \tag{3}$$

The radius may then be solved for as shown in the equation below:

$$R=\frac{g}{\omega^2_{satelization}} \tag{4}$$

Thus, in determining the amount of imbalance at 208, the controller 96 may accelerate the drum 16 through a satellizing speed for the laundry and may determine the rotational speed of the drum 16 at which the laundry satellizes to define a determined satellizing speed. For example, the controller 96 may determine the satellizing speed by determining a rotational speed of the drum 16 when a high frequency component of a torque signal of the motor 88 satisfies a reference value. By way of alternative example, the satellizing speed may be determined by determining a rotational speed of the drum 16 when the torque signal of motor 88 matches a reference torque signal. While the satellizing speed may be determined in either of these ways it will be understood that any method for determining the satellization speed may be used as the method of determining is not germane to the invention. The controller 96 may calculate the radius of the imbalance based on the determined satellizing speed.

It is contemplated that the calculated radius may be adjusted based on a known radius of the drum. For example, the radius (r) may be adjusted to be a radius somewhere between the calculated radius and the known radius of the drum 16. This may aid in determining that the mass of the imbalance is acceptable.

More specifically, the torque of the motor ($\tau_{motor}$) a function of the torque caused by the imbalance 114 ($\tau_{imbalance}$) and torque caused by friction ($\tau_{friction}$). When the equation is solved for the torque of the imbalance ($\tau_{imbalance}$) the resulting equation is:

$$\tau_{imbalance}=\tau_{motor}-\tau_{friction} \tag{5}$$

The torque of the motor ($\tau_{motor}$) may be a measured value such as from the motor torque sensor 106. The torque caused by friction ($\tau_{friction}$) is a constant for the washing machine 10 for a given speed and acceleration. The torque caused by the imbalance 114 ($\tau_{imbalance}$) is a function of the radius (r) at which the imbalance 114 is located with respect to an axis of rotation 240, the force of gravity, and the angle of the imbalance. More specifically, the equation for the torque caused by the imbalance 114 ($\tau_{imbalance}$) is:

$$\tau_{imbalance}=R*F_{gravity}*\cos(\theta) \tag{6}$$

In looking at the change in the torque of the motor ($\tau_{motor}$) between the peak and the trough the equation may be represented by:

$$\tau_{motor_peak}-\tau_{motor_trough}=\tau_{imbalance_peak}+\tau_{friction_peak}-(\tau_{imbalance_trough}+\tau_{friction_trough}) \tag{7}$$

It has been determined that the torque caused by friction ($T_{friction}$) drops out and does not need to be determined as it is the same and not a function of the angle of the imbalance. The difference in the torque of the motor ($\tau_{motor}$) $_{may}$ be represented by the equation:

$$\Delta\tau_{motor}=\Delta\tau_{imbalance}=R*F_{gravity}(\cos(0°)-\cos(180°))=2*R*F_{gravity} \tag{8}$$

When solving the equation (8) for the force of gravity the equation may be represented by the equation:

$$F_{gravity} = \frac{\Delta\tau_{motor}}{2 * R} \tag{9}$$

As explained above with respect to equation (2) gravitational force is a function of the mass of the imbalance and gravity, when such equation is solved for the mass of the imbalance and the force of gravity equation is substituted from equation (9) the mass of the imbalance may be determined by the equation below:

$$Mass_{imbalance} = \frac{\Delta\tau_{motor}}{2 * R * g} \tag{10}$$

Thus, it has been determined that the mass of the imbalance is a function of the change in the motor torque and the radius at which the imbalance is located with respect to an axis of rotation 240. The mass of the imbalance is directly proportional to the change in the motor torque represented by the peak-to-peak value and may be determined by the controller 96.

The controller 96 may compare the amount of imbalance to a threshold imbalance value at 210 to determine whether the determined imbalance is acceptable. This may include the controller 96 determining whether the determined imbalance satisfies a predetermined imbalance amount threshold. The controller 96 may accomplish this by comparing the determined amount to a predetermined imbalance threshold to see if the determined amount satisfies the predetermined threshold. To do this, the controller 96 may compare the determined amount, either continuously or at set time intervals, to the predetermined threshold value.

The term "satisfies" the threshold is used herein to mean that the amount of the determined imbalance satisfies the predetermined threshold, such as being equal to, less than, or greater than the threshold value. It will be understood that such a determination may easily be altered to be satisfied by a positive/negative comparison or a true/false comparison. For example, a less than threshold value can easily be satisfied by applying a greater than test when the data is numerically inverted.

The predetermined imbalance threshold value may be determined experimentally and stored in the memory 100 of the controller 96. It has been contemplated that the predetermined imbalance threshold value may be a predetermined imbalance range and that the predetermined imbalance threshold may be satisfied when the determined imbalance falls within the predetermined amount range. It has been contemplated that there may be multiple predetermined amount threshold values and that during the comparison it may be determined which of the multiple values is satisfied. It is contemplated that the amount of imbalance may be repeatedly compared with the threshold value during the acceleration of the drum 16 through the satellizing speed for the laundry load. Further, the threshold value may change and the threshold value may be determined by the controller 96. More specifically, the threshold value may be determined from a rotational speed of the drum 16 and inertia of the laundry load. Thus, determining the threshold value may also include determining the inertia of the laundry load. It is contemplated that the threshold value may be determined by the controller 96 based on an algorithm or that the controller 96 may set the threshold value by conducting a table lookup of the threshold value from a table of a plurality of threshold values 120 (FIG. 2), which may be contained in the memory 100.

It is contemplated that the imbalance may be determined to be acceptable initially without having to take corrective action and the cycle of operation may continue as at 212. If the comparison indicates the determined amount of imbalance does not satisfy the threshold imbalance at 210, then corrective action may be taken at 214. Such corrective action may include that the drum 16 may be decelerated from the satellizing speed to a non-satellizing speed. The deceleration of the drum 16 may include controlling the motor 88 to decrease the speed of the drum, shutting off power to the motor 88, or dynamically braking the drum 16 with the motor 88. The controller 96 may take corrective action by initiating a redistribution phase to redistribute the laundry within the treating chamber 18. Such redistribution may be done in a variety of ways. For example, this may include operating the motor 88 such that the speed of the drum 16 is dropped just below the satellizing speed and then brought back up to the satellizing speed such that the speed of the drum 16 oscillates around the satellizing speed, this is sometimes referred to as a short distribution. Alternatively, this may include operating the motor 88 such that the rotation of the drum 16 is stopped altogether and then bringing the drum 16 back up to the satellizing speed, this is sometimes referred to as a long distribution.

It will be understood that the method to determine an amount of imbalance of the laundry load in the drum based on a determined average peak-to-peak value and taking corrective action when the determined amount of imbalance does not satisfy a threshold is flexible and that the method 200 illustrated is merely for illustrative purposes. For example, it is contemplated that threshold value may change during an acceleration of the drum 16 through the satellizing speed for the laundry load.

Figure 9:
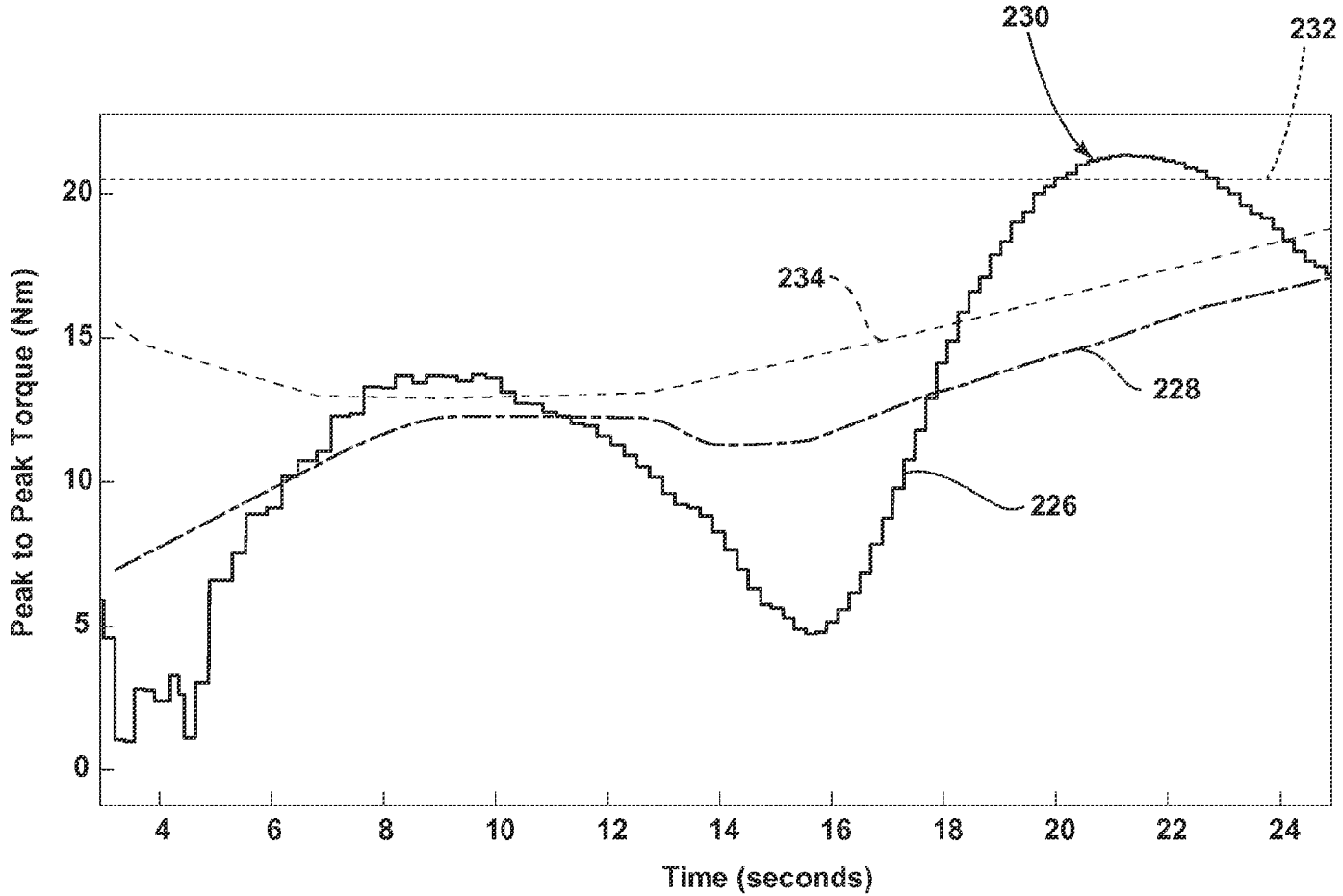
FIG. 9 illustrates an exemplary graph of peak-to-peak values over time based on motor torque of the motor that drives the drum from the laundry treating appliance of FIG. 1.

It has been determined that the balancing material moveable within the balance ring 38 will affect the imbalance calculation. More specifically, the balancing material moveable within the balance ring 38 acts as a noise on the torque signal and the balancing material moves in and out of phase with the imbalance mass. Because of the effect of the balancing material the peak-to-peak torque value would fail to provide an accurate imbalance measurement. For this reason, it has been determined that the average of the peak-to-peak values should be used in the calculation because the average peak-to-peak value gives an indication of the imbalance 114 caused by the laundry items 116. For exemplary purposes, in FIG. 9, the peak-to-peak value is illustrated as 226 and the average peak-to-peak value has been indicated as 228. If the peak-to-peak value 226 was used instead of the average peak-to-peak value 228 then at the point 230 the imbalance would be determined to be unacceptable because it is above a threshold 232. The peak-to-peak value at 230 is so high because the balancing material is in phase with the imbalance in the drum 16. This can cause the washing machine 10 to unnecessarily redistribute the laundry items 116. It has also been determined that a single peak-to-peak value does not necessarily make for an accurate imbalance measure thus, regardless of the inclusion of the balance ring 38 within the washing machine 10 the use of the average value is beneficial.

By way of non-limiting example, a changing threshold has been indicated as 234. It may be seen that near the start of the monitored time that the threshold 234 is larger and further away from the peak-to-peak value 226 and the average peak-to-peak values 228. This is so that an initial high value does cause an unnecessary redistribution. As time continues, the changing threshold 234 may get tighter with the average peak-to-peak values 228 because there is less of a chance that the average peak-to-peak values 228 will be thrown off by a high peak-to-peak value 226.

The above described embodiments provided a variety of benefits including that the cycle of operation of the laundry treating appliance may be operated in an effective and efficient manner. While the waveforms containing data for the motor torque have been available to those skilled in the art for a long time, the Inventors have determined that the motor torque data can be used to determine the degree of imbalance. This method can be used to accurately determine the existence of an imbalance in a laundry treating appliances with or without ball balancers. Additionally, this degree of imbalance is determined from the motor torque data in real-time. In this sense, the use of the data amounts to a real-time sensor placed in the drum for determining the amount of imbalance. Thus, the use of the motor torque data can be thought of as a "virtual" imbalance sensor. The ability to determine or sense the amount of imbalance is very beneficial to improving the laundering performance as an imbalance of the laundry load may be determined in real time and the load may be redistributed accordingly.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a drum at least partially defining a treating chamber for receiving a laundry load, at least one balance ring coupled to the drum and containing moveable balancing material, and a motor for rotating the drum, the method comprising:

rotating the drum by operating the motor;

repeatedly determining an amplitude of a peak-to-peak value of a motor torque during the rotating of the drum to provide multiple peak-to-peak values;

determining an average peak-to-peak value from the multiple peak-to-peak values;

determining an amount of imbalance of the laundry load in the drum based on the determined average peak-to-peak value;

comparing the amount of imbalance to a threshold imbalance value; and taking corrective action when the comparison indicates the determined amount of imbalance does not satisfy the threshold imbalance.

2. The method of claim 1 wherein a magnitude of the average peak-to-peak value is proportional to the amount of imbalance.

3. The method of claim 1 wherein the determining an amount of imbalance comprises determining a radius from a center of rotation of the drum to a center of mass of the imbalance.

4. The method of claim 3 wherein a length of the radius is inversely proportional to the amount of imbalance.

5. The method of claim 3 wherein the determining the radius of the imbalance includes determining a speed at which the laundry load satellizes to define a determined satellizing speed.

6. The method of claim 5 wherein determining the determined satellizing speed comprises determining a rotational speed of the drum when a high frequency component of a torque signal of the motor satisfies a reference value.

7. The method of claim 5 wherein determining the determined satellizing speed comprises determining a rotational speed of the drum when a torque signal of the motor rotating the drum matches a reference torque signal.

8. The method of claim 5 wherein the determining the radius of the imbalance includes calculating the radius of the imbalance based on the determined satellizing speed.

9. The method of claim 8 wherein the determining the radius of the imbalance comprises adjusting the calculated radius based on a known radius of the drum.

10. The method of claim 1 wherein the determining the average peak-to-peak value includes determining a running average peak-to-peak value.

11. The method of claim 10 wherein the repeatedly determining the amplitude of a peak-to-peak value of the motor torque occurs during an acceleration of the drum through a satellizing speed for the laundry load.

12. The method of claim 11 wherein the threshold value changes during an acceleration of the drum through the satellizing speed for the laundry load.

13. The method of claim 12, further comprising repeating the comparing the amount of imbalance to the threshold value during the acceleration of the drum through the satellizing speed for the laundry load.

14. The method of claim 11, further comprising determining the threshold value during the acceleration of the drum.

15. The method of claim 14 wherein the threshold value is determined from a rotational speed of the drum and inertia of the laundry load.

16. The method of claim 15 wherein determining the threshold value further comprises determining the inertia of the laundry load.

17. The method of claim 1 wherein the taking corrective action comprises initiating a re-distribution phase to redistribute the laundry load within the treating chamber when the determined amount of imbalance does not satisfy the threshold.

* * * * *